US005829511A

United States Patent [19]

Uzaki et al.

[11] Patent Number: 5,829,511

[45] Date of Patent: Nov. 3, 1998

[54] CORES FORMED WITH CONNECTING CAVITIES FOR RECEIVING CONNECTING SAND

[75] Inventors: Nagato Uzaki, Toyohashi; Masayoshi Kasazaki; Hisashi Harada, both of Hoi-gun; Kazuo Sugimoto, Toyokawa, all of Japan

[73] Assignee: Sintokogio, LTD., Nagoya, Japan

[21] Appl. No.: 999,478

[22] Filed: Dec. 29, 1997

Related U.S. Application Data

[62] Division of Ser. No. 804,028, Feb. 19, 1997.

[30] Foreign Application Priority Data

Feb. 23, 1906 [JP] Japan ..... 8-61983
Feb. 23, 1996 [JP] Japan ..... 8-61984

[51] Int. Cl.[6] ..... B22C 9/10

[52] U.S. Cl. ..... 164/369

[58] Field of Search ..... 164/369, 339, 164/168, 137, 340

[56] References Cited

U.S. PATENT DOCUMENTS 4,989,661 2/1991 Erana ..... 164/137

FOREIGN PATENT DOCUMENTS 7-314089 12/1995 Japan .

*Primary Examiner*—Kuang Y. Lin
*Attorney, Agent, or Firm*—Limbach & Limbach L.L.P.

[57] ABSTRACT

Cores have a plurality of cavities defined by adjacent vertical side surfaces of two adjacent cores. These cavities are arranged horizontally and spaced apart along the surfaces. Providing such a plurality of cavities in the surfaces produces an increased total surface area extending in the direction where the cores mate or separate.

1 Claim, 4 Drawing Sheets

CORES FORMED WITH CONNECTING CAVITIES FOR RECEIVING CONNECTING SAND

This is a divisional of application Ser. No. 08/804,028, filed Feb. 19, 1997.

BACKGROUND OF THE INVENTION

1. Field of the Invention

This invention relates to cores formed with connecting cavities in their adjacent connecting surfaces for receiving connecting sand, and also to a method of connecting a plurality of cores in an assembly by charging connecting sand into such connecting cavities.

2. Description of the Prior Art

Japanese Patent No. 3-46214 B, which corresponds to Spain Patent Application No. 87-03026, filed Oct. 22, 1987, teaches a method for connecting a plurality of cores to an assembly by charging connecting material or sand into their big grooves or cavities, each formed in the upper surface of the core. These cavities are aligned with each other when the cores are arrayed.

However, since these big cavities, which are formed to reduce the weight of the cores, are filled with connecting sand or molding sand, the assembly of the cores becomes heavy.

Japanese Patent No. 5-123824 A teaches a method for producing an assembly of cores by connecting and completing uncompleted cores (each core lacks a part) by charging molding sand into a cavity defined by a mold for the lacking parts, which mold is put on the uncompleted cores. In this method the molding sand tends to be blown out of the gaps between the uncompleted cores and the mold for the lacking parts. Further, the completed assembly of cores tends to be uneven or tends to have steps at the junctions of the uncompleted cores and mold. Further, performing this method requires a bulky and expensive molding machine.

Japanese Patent No. 7-314089 A teaches a method for charging molding sand into big cavities, each defined by a pair of opposed and mated cavity halves formed in the upper side surfaces of adjacent cores., However, in this method, since the adhesive strength of the molding sand adhering to the surfaces of each cavity of the adjacent cores is low, the cores tend to separate.

The conventional method, for example, in the above patents, for charging connecting sand or molding sand into the cavities of the cores, is the blow-charge method. In this method compressed air is supplied into a blowing head that contains a large amount of connecting sand. The amount is sufficient to fill the cavities, i.e., it is more than that necessary to fill one cavity. Since in this method particles of the connecting sand are blown by air, a blowing head is pressed against the upper surfaces of the cores to prevent the particles escaping with the air from the gap between the blowing head and the upper surfaces of the cores. Further, to completely prevent the particles from escaping from the gap, the gap must be sealed. Further, the method requires charging the connecting sand with air under a high pressure to make the charged sand highly dense so as to obtain a high adhesive strength for it so that it can adhere to the cores. However, the air pressure is limited to a low one, because the cores are weak.

The present invention was conceived to overcome the disadvantages of the prior art mentioned above. Thus this invention aims to provide cores which can be sufficiently connected when their cavities are filled with connecting sand, and it also aims to provide a method for connecting the cores by charging connecting sand into them, wherein the seal at the junctions of a blowing machine and the cores is eliminated, and wherein no bulky, expensive blowing machine is required.

SUMMARY OF THE INVENTION

The cores of the invention have a plurality of cavities defined by adjacent surfaces of two adjacent cores. These cavities are arranged horizontally and spaced apart along the surfaces. Providing such a plurality of cavities in the surfaces produces an increased total surface area extending in the direction where the cores mate (or face) or separate. Thus, when the connecting sand, such as a molding sand, is charged into the cavities, the adhesive strength of the connecting sand to the cores, i.e., the core-to-core adhesive strength (i.e., an allowable shearing force) in that direction becomes higher than that of Japanese Patent No. 7-314089, where one cavity is formed between two adjacent cores.

The size of each cavity between adjacent cores is such that when a force is applied to the cores in the direction where they separate, the ratio of the area of a surface on which a tensile force works to the area of a surface on which a shearing force works is 1:1–3:1, preferably, 1.5:1–2:1. By this range of the ratios of these areas, the adhesive strengths of the connecting sand to both surfaces subjected to the tensile and shearing forces balance.

The method of this invention for connecting a plurality of cores in an assembly through adjacent surfaces of the cores by charging connecting sand into cavities formed between adjacent surfaces of adjacent cores includes the steps of indexing a hopper nozzle containing a predetermined amount of connecting sand therein above the cavities, and supplying compressed air into the hopper nozzle, thereby projecting and charging the mass of the connecting sand from the hopper nozzle into the cavities. In this method the mass of the predetermined amount of the connecting sand is projected like a ball or projectile from the nozzle and is charged into the cavities. Since the cavities are open, the compressed air that entered them escapes from their upper open ends.

DESCRIPTION OF THE PREFFERED EMBODIMENTS

Now the cores and the method of the invention are explained below by reference to the drawings.

Figure 1:
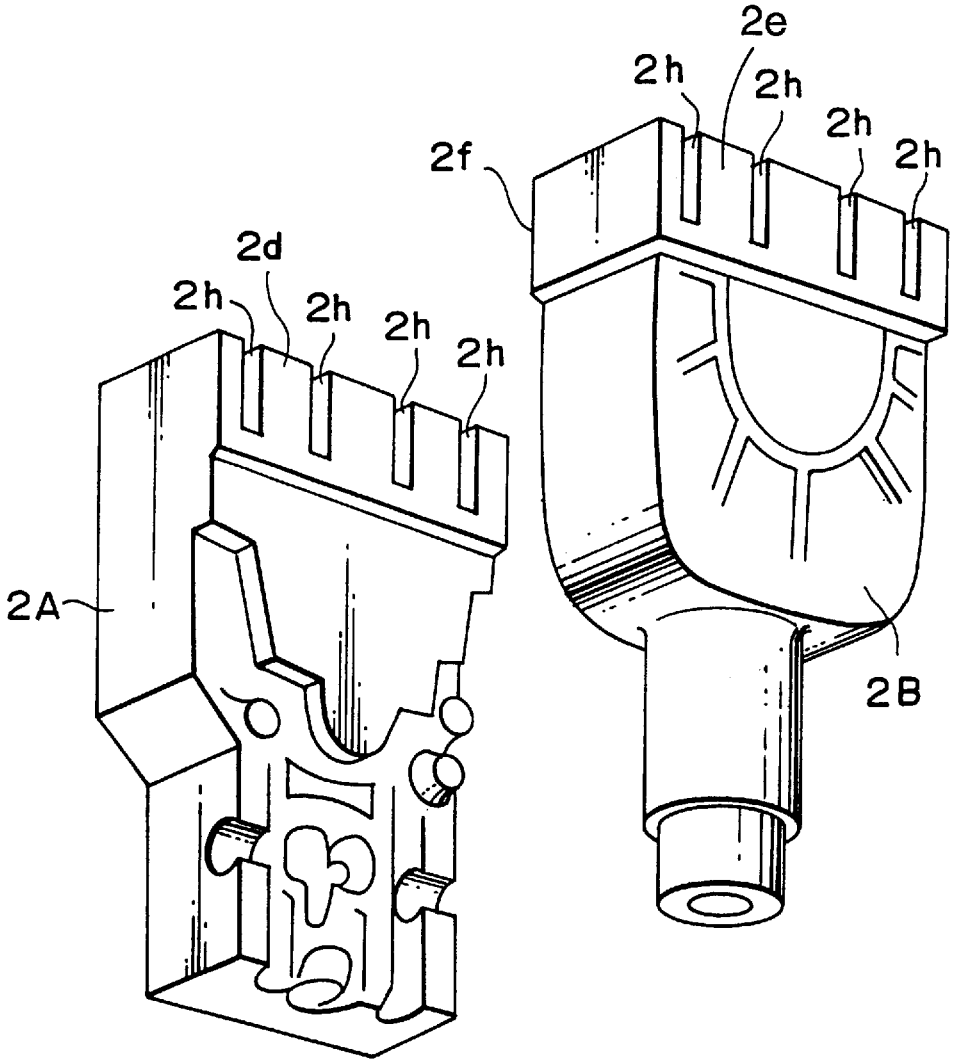
FIG. 1 is a perspective view of two cores (from left to right a side core and an intermediate core) of the embodiment of the present invention.
Figure 2:
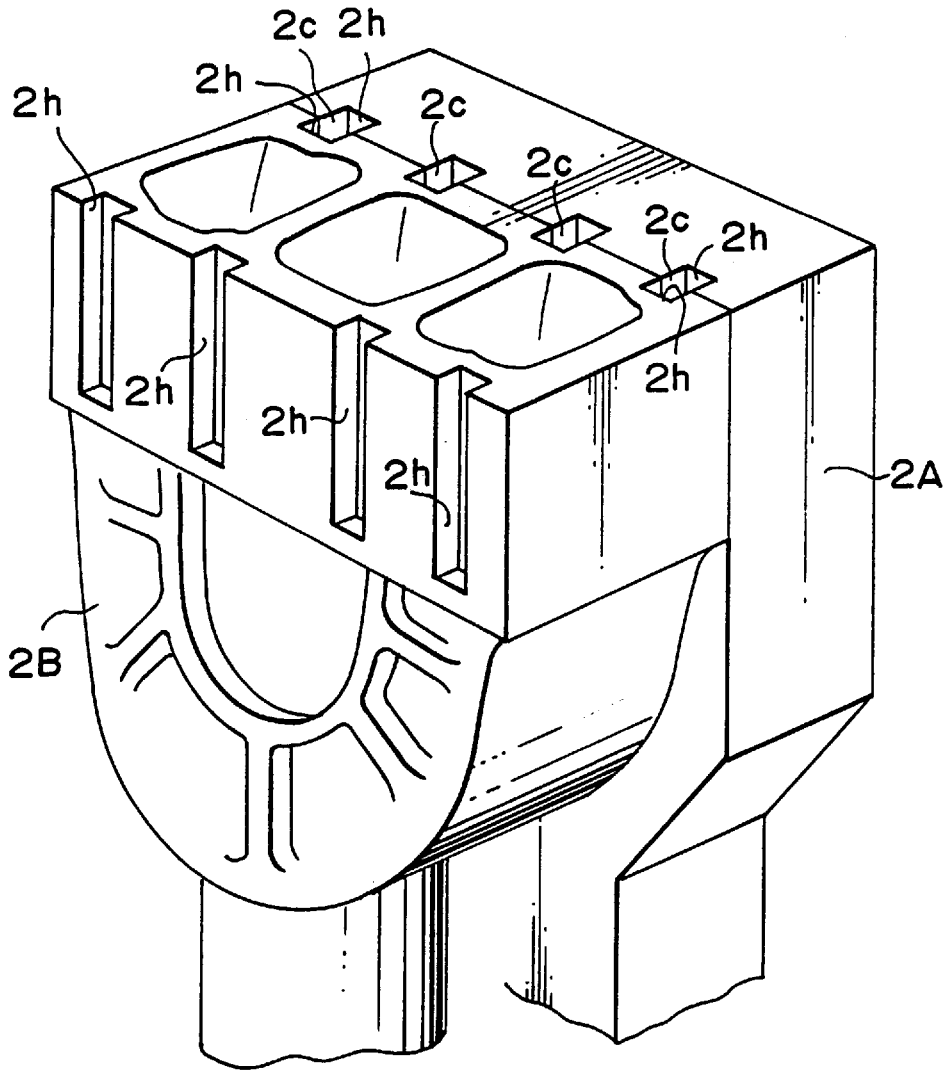
FIG. 2 is a perspective view of an assembly of an intermediate core and a side core of the embodiment.
Figure 3:
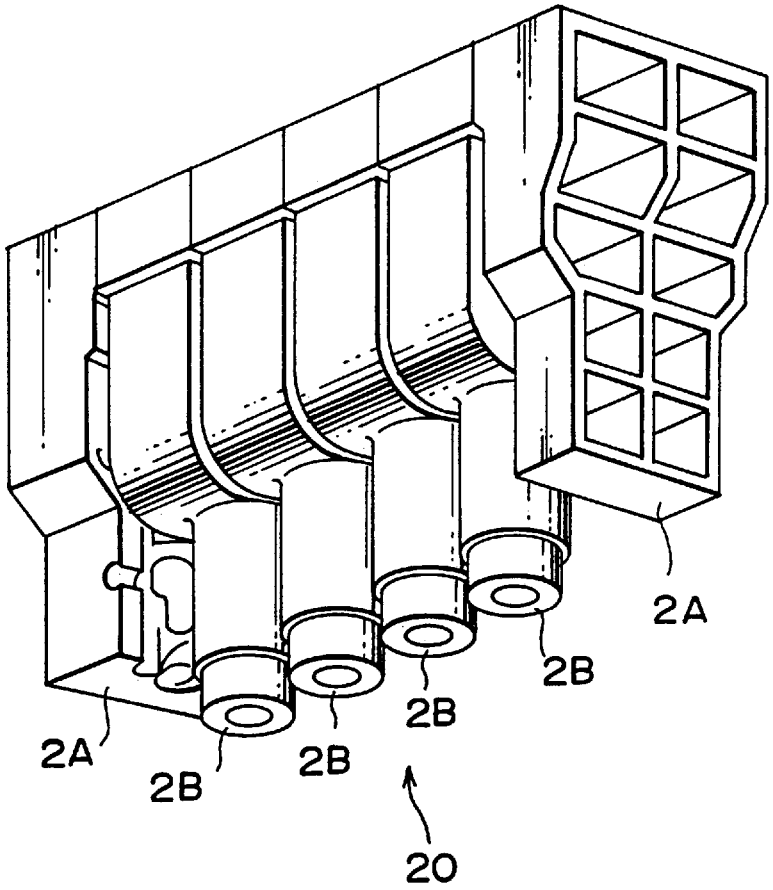
FIG. 3 is a perspective view of all the cores of the embodiment, which cores are arrayed or connected in an assembly.

First, in FIGS. 1, 2, and 3 the embodiment of the cores of the invention is explained. These Figures show a plurality of cores comprised of two side cores 2A and four intermediate cores 2B. These cores are arrayed and connected to form an assembly or mold 20 (FIG. 3). As in FIG. 1, the side core 2A has a vertical surface 2*d* at the upper part of one of its sides. A plurality of depressions or cavity halves 2*h* (four are shown in the drawing) are formed in the surface 2*d*. These cavity halves 2*h* are horizontally spaced apart along the surface 2*d*. Each intermediate core 2B has vertical surfaces 2*e*, 2*f* at the upper parts of its sides. The vertical surfaces 2*e*, 2*f* each also have a plurality of depressions or cavity halves 2*h*. The width, depth, and length (vertical dimension) of all the cavity halves 2*h* in the surfaces 2*d*, 2*e*, 2*f* are the same. When the cores 2A, 2B are arrayed or assembled, the surface 2*d* of the side core 2A and the surface 2*f* of the intermediate core 2B mate, and the cavity halves 2*h* in the surface 2*d* of the side core 2A and the cavity halves 2*h* in the surface 2*f* of the intermediate core 2B mate. The mated, adjacent cavity halves 2*h*, 2*h* define a plurality of cavities 2*c* which are horizontally spaced apart between the adjacent surfaces of the cores. This is the same as in two other adjacent cores (two adjacent intermediate cores 2B, 2B).

Now by reference to FIG. 4 the embodiment of the method of the invention for connecting the plurality of cores shown in FIGS. 1, 2, and 3 by charging connecting sand into the cavities 2*c* formed between them is explained below.

Figure 4:
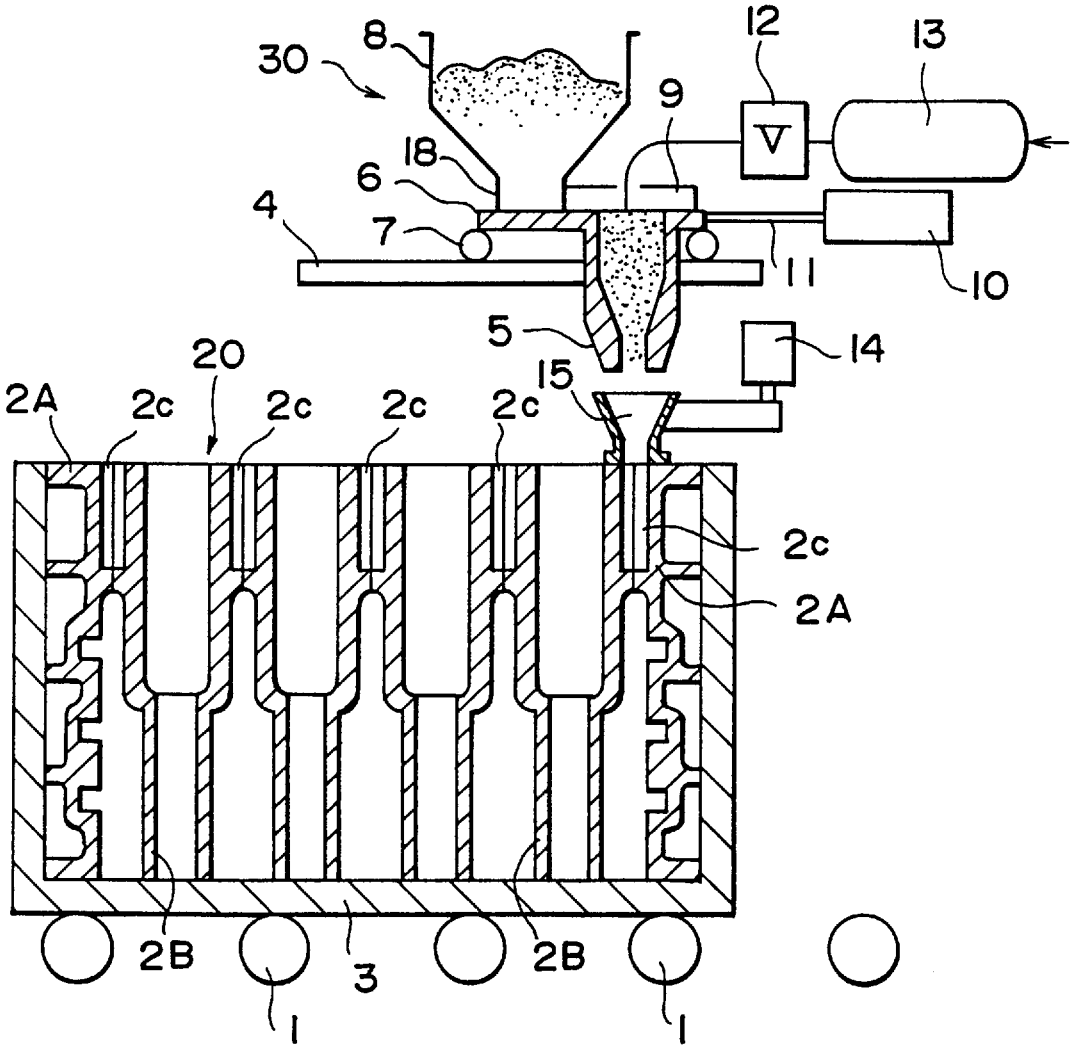
FIG. 4 is a partly cross-sectional view of the assembly and a device to charge connecting sand into connecting cavities of the assembly.

FIG. 4 shows an assembly 20 of cores and a connecting-sand-charging machine 30 located above the assembly 20. The assembly 20 is held in a box 3.

This box is laterally moved along rollers 1. The machine 30 includes a frame 4 (only a part of it is shown in the drawing), a nozzle body 6 movably mounted on the frame 4, and a hopper 8 suspended from the frame 4. The frame has rollers 7 on which the nozzle body 6 is slidably mounted. The nozzle body 6 has four hopper nozzles 5 (one is seen in the drawing), the same number as of the cavities 2*c*. The volume of the hollow space in each nozzle 5 is substantially equal to that of a cavity 2*c*. One or more cylinders 10 are connected to the nozzle body 6 so that it can move horizontally when pushed or pulled by a piston rod or rods 11 of the cylinder or cylinders 10. The hopper 8, which contains a large amount of connecting sand, has four discharging ports 18 (only one is shown in the drawing) at its lower end. The ports 18 are closed by an upper plate portion of the nozzle body 6. A cover plate 9 is attached to the lower end of the hopper 8. This plate 9 covers all the nozzles 5.

When the cylinder or cylinders 10 are operated, the upper plate portion of the nozzle body 6 slides between the fixed cover 9 and rollers 7 fixed to the frame 4 so that all the nozzles 6 communicate with the discharging ports 18 of the hopper 8 and are filled with a predetermined amount of the connecting sand. Then they return to their original positions shown in FIG. 4 and are covered with the cover plate 9, while the discharging ports 18 are closed by the nozzle body 6. In FIG. 4 four nozzles 5 are located just above four cavities 2*c* formed in the adjacent surfaces of the adjacent cores 2A, 2B shown in FIG. 2.

The nozzles 5 communicate with a compressed-air tank 13 through the cover plate 9 and a valve 12. Thus when the valve 12 is opened, the mass of the connecting sand in each hopper nozzle 5 is projected from it like a ball and charged into each cavity 2*c* through a guiding chute 15 mounted on the upper surface of the cores 2A, 2B. The nozzle body 6 is moved until it is located just under the hopper 8 to receive the connecting sand from it, and then returns to its original position.

While the nozzle body 6 moves between its original position and the hopper 8, the chute 15 is moved up by an actuator 14 mounted on the frame 4 and connected to the chute 15. Then, the box 3 is horizontally moved so that the cavities of the next adjacent cores 2B, 2B face the nozzles 5, which are filled with the connecting sand. The chute 15 is then lowered and mounted on the upper surfaces of the adjacent cores, so that their cavities are ready for receiving the projected masses of the connecting sand from the nozzles 5.

This procedure is repeated until the cavities of all the adjacent cores are charged with connecting sand.

The embodiments explained above are just exemplary. The invention of the present invention is not limited to them. For example, instead of providing a plurality of nozzles 5 for the frame 4 and discharge ports 18 for the hopper 8, just one nozzle 5 and one discharging port 18 may be provided, and the box 3 may be moved in two orthogonal directions in a horizontal plane instead of being moved in one direction. Further, although in the above embodiment the assembly of cores is moved relative to the nozzles to index them above the cavities of the cores, alternatively, the assembly of the cores may be fixed, and the nozzle or nozzles may be horizontally moved in one or two orthogonal directions by using a conventional, known method.

What we claim is:

1. Cores to be connected in an assembly, the cores having vertical side surfaces, two of the cores when positioned adjacent to each other having a plurality of cavities formed in the adjacent vertical side surfaces, the cavities being arranged horizontally and spaced apart along the adjacent vertical side surfaces.

* * * * *